United States Patent [19]

Killian

[11] 3,965,884

[45] June 29, 1976

[54] TRIGGERLESS ARCHERY BOW STRING RELEASE

[76] Inventor: Gerald I. Killian, 16016 SE. 82nd Drive, Clackamas, Oreg. 97015

[22] Filed: Mar. 14, 1975

[21] Appl. No.: 558,269

[52] U.S. Cl. ..... 124/35 A

[51] Int. Cl.[2] ..... F41C 19/00

[58] Field of Search ..... 124/35 R, 30 R, 41 A, 124/35 A, 25

[56] References Cited

UNITED STATES PATENTS

| | | | |
|---|---|---|---|
| 229,089 | 6/1880 | Burnham | 124/35 A |
| 707,000 | 8/1902 | Pease | 124/35 R UX |
| 2,417,791 | 3/1947 | Tyszkiewicz | 124/35 A |
| 3,687,458 | 8/1972 | Proctor | 272/68 X |
| 3,845,752 | 11/1974 | Barner | 124/35 A |
| 3,853,111 | 12/1974 | Stanislawski | 124/35 A |

*Primary Examiner*—Richard C. Pinkham
*Assistant Examiner*—William R. Browne
*Attorney, Agent, or Firm*—Oliver D. Olson

[57] ABSTRACT

A bow string support lever is pivoted intermediate its ends on an arm which is in turn pivoted on a body member which includes a pair of finger grips. A catch on one end of the lever is arranged to engage a pawl operatively associated with the body member when the lever and arm are pivoted to a cocked position, whereby to secure the lever against pivotal movement. A hook on the opposite end of the lever is arranged to receive the bow string and to support the latter when in said cocked position. Upon slight lateral movement of the body member, the catch is disengaged from the pawl whereupon the lever is released to pivot from the cocked position and allow the bow string to disengage from the hook.

8 Claims, 9 Drawing Figures

S
A
4
10
12
14
16
18
20
22
24
26
28
30
32
34
36
38
40
42
44
46
48

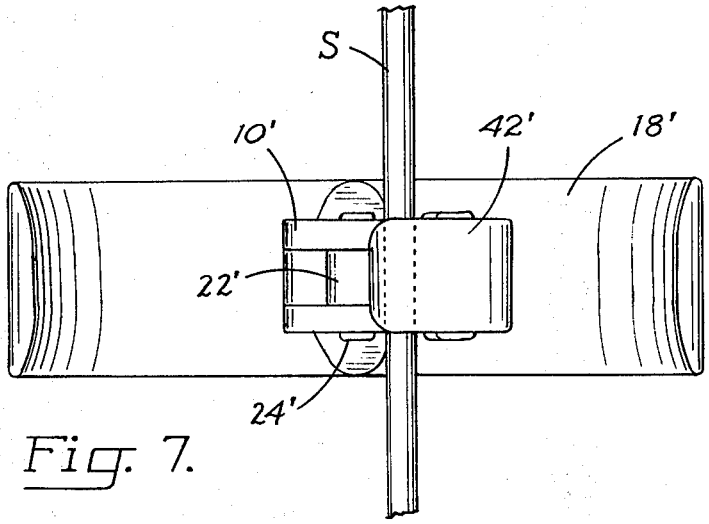
Fig. 7.
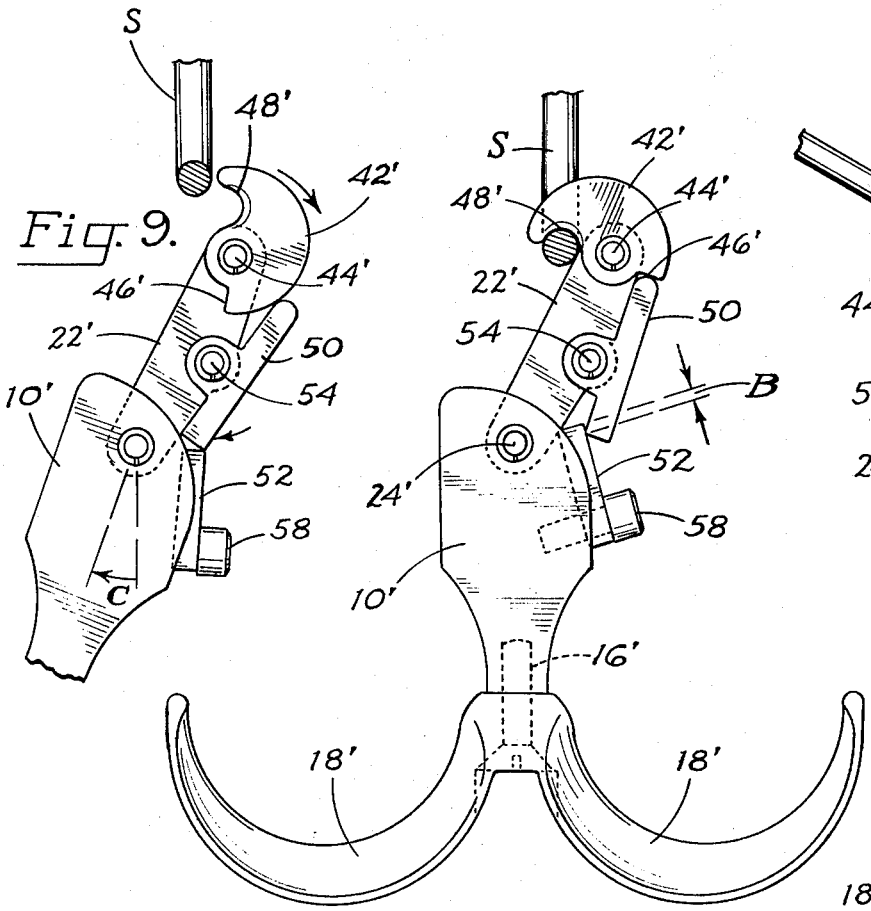
Fig. 9.
Fig. 6.
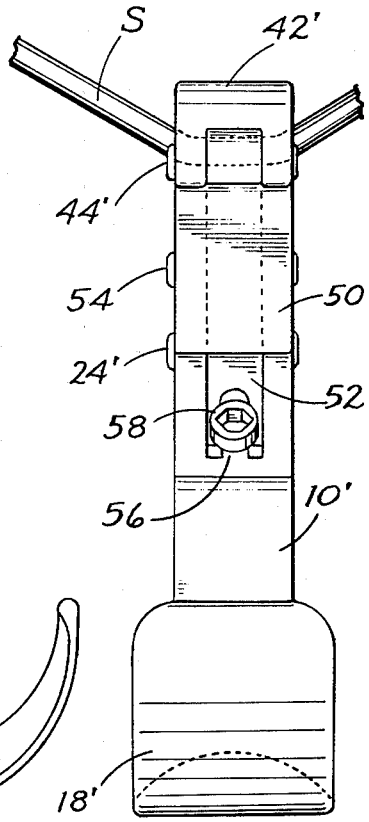
Fig. 8.

TRIGGERLESS ARCHERY BOW STRING RELEASE

BACKGROUND OF THE INVENTION

This invention relates to archery, and more particularly to novel mechanical means for releasably supporting an archery bow string for the drawing and shooting of an arrow.

Conventionally, the drawing of an arrow is accomplished by pulling rearward on the bow string either with the bare fingers or with a flexible finger tab interposed between the fingers and the bow string. In both instances, the bow string is released from the drawn position of the arrow by straightening the fingers. This motion is accompanied by a lateral movement of the blow string as the latter rolls over the fleshy portion of the finger tips. Although such lateral movement is reduced by the use of flexible finger tabs, as distinguished from bare fingers, sufficient lateral movement still is produced that the degree of shooting accuracy is impaired.

Various structural forms of mechanical devices have been proposed heretofore for replacing the fingers as the means for drawing and releasing the arrow. Such mechanical releases heretofore have been of two types: A simple, laterally notched member provided with a finger grip serves to retain a bow string within the notch until the member is rotated to allow the bow string to escape the notch. This type of mechanical release not only requires an unnatural movement of the hand to effect release, but it also results in lateral movement of the bow string.

Trigger type mechanical releases of complex and costly construction provide various forms of movable hook members arranged to be secured in a cocked position in which it supports a bow string and from which cocked position it is released by movement of a trigger mechanism operable by a finger of the archer's hand. Not only is this complex type of mechanism costly to manufacture and maintain in operative condition, but it also requires an unnatural finger movement to operate the trigger. Such unnatural finger movement creates tension in the arm and hand of the archer, resulting in undesired movements of the bow and consequent loss of shooting accuracy.

SUMMARY OF THE INVENTION

In its basic concept, this invention provides a triggerless archery bow string release in which a natural movement of the archer's arm and hand, upon attainment of full draw of the arrow, functions to effect release of a bow string support lever from a cocked, string-supporting position to an uncocked, string-releasing position.

It is by virtue of the foregoing basic concept that the principal objective of this invention is achieved; namely, to overcome the aforementioned limitations and disadvantages of prior archery bow string release methods and devices.

Another important object of this invention is the provision of a triggerless archery bow string release device which is adjustable to vary the sensitivity of release.

A further important object of this invention is a provision of a triggerless archery bow string release device which is operable by both right and left hand archers.

Still another objective of this invention is the provision of a triggerless archery bow string release device which is of simplified construction for economical manufacture and which is operable with reproducible precision with minimum maintenance.

The foregoing and other objects and advantages of this invention will appear from the following detailed description, taken in connection with the accompanying drawings of preferred embodiments.

BRIEF DESCRIPTION OF THE DRAWINGS

FIG. 6 is a plan view of a triggerless archery bow string release device of this invention in another of its embodiments, the device being shown in the cocked position of the bow string support lever.

FIG. 7 is a front view as viewed from the top in FIG. 6.

FIG. 8 is a side elevation as viewed from the right in FIG. 6.

FIG. 9 is a fragmentary plan view, similar to FIG. 6, showing the bow string support lever in uncocked position.

DESCRIPTION OF THE PREFERRED EMBODIMENTS

Figures 1, 2, 3, 4, 5:
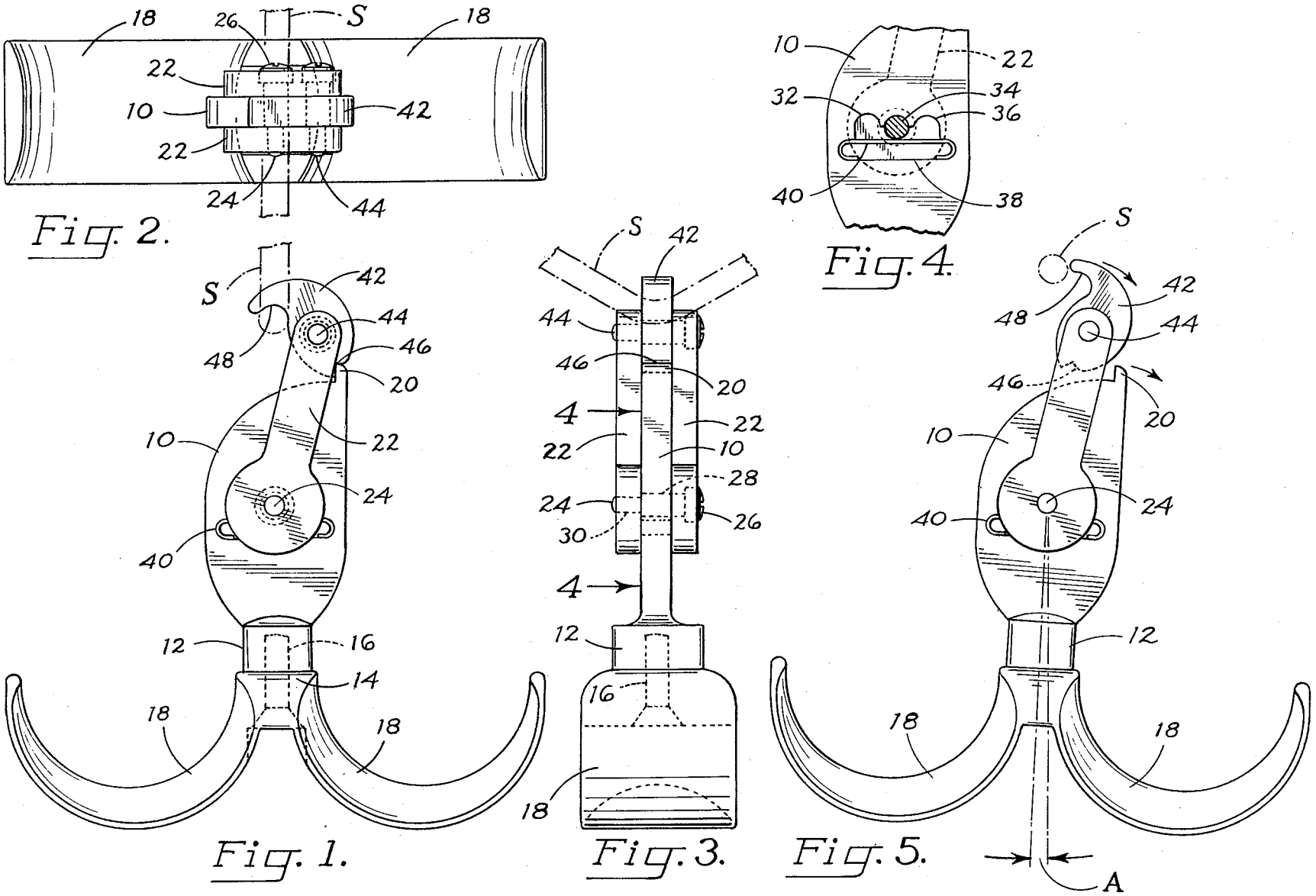
FIG. 1 is a plan view of a triggerless archery bow string release device embodying features of this invention, the device being shown in the cocked position of the bow string support lever preliminary to release of the bow string.
FIG. 2 is a view in front elevation as viewed from the top in FIG. 1.
FIG. 3 is a view in side elevation as viewed from the right in FIG. 1.
FIG. 4 is a fragmentary sectional view taken on the line 4—4 in FIG. 3.
FIG. 5 is a plan view, similar to FIG. 1, showing the release device in the uncocked position of the bow string support lever.

Referring first to the embodiment illustrated in FIGS. 1–5, a flat body member 10 is provided at its rearward end with an enlarged boss 12 to which the central portion 14 of a laterally extending two-finger grip member is secured, preferably by a screw 16 which allows rotational adjustment of the finger grip relative to the plane of the body member.

The finger grip member is elongated laterally from the central portion and the end portions are curved arcuately to provide a pair of laterally spaced, forwardly concave finger grips 18 for reception of two fingers of an archer's hand.

The forward end of the body member is provided with a forwardly extending pawl 20 the function of which is described in detail hereinafter.

A pair of arms 22 are disposed one on each of the opposite sides of the flat body member 10 and the rearward ends of the arms are connected pivotally to the body member intermediate the ends of the latter. In the embodiment illustrated, this pivot connection is provided by a stepped pivot screw 24 having an enlarged head 26 at one end, and intermediate pivot pin portion 28 of lesser diameter and a threaded end portion 30 of still lesser diameter. As best illustrated in FIG. 3, the pivot screw extends from the right through openings of corresponding diameter in the body member 10 and arms 22. Thus, the threaded end portion 30 of the screw is secured in a correspondingly threaded bore in the left hand arm; the intermediate portion 28 of the screw is received freely in unthreaded bores in the body member and inner portion of the right hand arm; and the enlarged head 26 is received in a corresponding counter bore in the outer portion of the right hand arm.

For purposes described more fully hereinafter, the intermediate portion 28 of the screw which extends through the body member 10 preferably is adjustable laterally of the body member to positions of varying sensitivity of bow string release. This adjustment is provided in the embodiment illustrated by forming in the body member 10 a plurality of laterally spaced, semi-circular bearing notches 32, 34 and 36 interconnected by a laterally elongated slot 38 rearwardly thereof. A resilient leaf spring 40 spans the slot rearwardly of the semi-circular openings and rearwardly of the intermediate portion 28 of the screw. Accordingly, the screw may be removed from any one of the semi-circular bearing notches by pressing rearwardly on the arms 22 to depress the leaf spring sufficiently to allow the intermediate portion 28 of the screw to be moved rearwardly of its engaged notch and then moved laterally to another one of the notches.

The forward ends of the arms 22 extend beyond the forward end of the body member 10 and mount between them a bow string support lever 42. The lever is connected intermediate its ends pivotally to the forward ends of the arms by means of a pivot pin 44, illustrated as being similar to the pivot screw 24 described hereinbefore. The axis of the pivot pin 44 is parallel to the axis of the pivot screw 24.

One lateral end of the support lever 42 is notched to provide a catch 46 arranged to engage the pawl 20 on the forward end of the body member (FIG. 1).

The opposite end portion of the support lever is recessed or otherwise contoured to provide a hook 48 in which to releasably retain a intermediate portion of a bow string S.

In the use of the release device illustrated in FIGS. 1–5, the support lever 42 is adjusted to the cocked position illustrated in FIG. 1 by rotating the arms 22 clockwise about the axis of the pivot screw 24 to bring the right hand end of the support lever adjacent the pawl 20, and then rotating the support lever about the axis of its pivot pin 44 to seat the pawl 20 in the catch 46. The bow string then is seated in the hook 48, two fingers of the archer's hand are engaged in the spaced finger grips 18 and the bow string pulled rearward to the position of full draw of an arrow which has been retained at its rearward end frictionally on the bow string adjacent the support lever.

At the position of full draw, and when the archer is ready to shoot the arrow, a slight lateral movement of the forward end of the body member 10 is caused to be made, as by an almost imperceptible clockwise rotation of the device about the axis of the pivot screw 24. This is illustrated by the angle A shown in FIG. 5. This rotation may be achieved by a right-handed archer by pulling rearward slightly with the finger engaging the right hand finger grip 18 (FIGS. 1 and 5) and relaxing the finger engaging the left hand finger grip. Alternatively, the rotation may be achieved by cocking the right wrist laterally toward the left during drawing of the arrow and then relaxing the wrist to allow it to straighten.

This lateral movement of the pawl 20 at the forward end of the body member 10 causes it to disengage from the catch 46, whereupon the support lever 42 is released from the cocked position illustrated in FIG. 1. The tension of the bow string pulling forwardly on the hook end of the support lever thereupon causes the latter to rotate rapidly clockwise to the position shown in FIG. 5. In this position the bow string is completely released from the hook of the support lever without having been caused to move laterally from its plane of forward movement. Accordingly, the arrow is projected with maximum accuracy to the intended target.

It is to be noted from FIG. 4 that the pivot screw for the arms is located in the central semi-circular notch 34 in the body member. When the screw is seated in the left hand notch 32 the sensitivity angle A is increased and the sensitivity of the device to uncocking movement is increased, whereas when the screw is seated in the right hand notch 36 the sensitivity is decreased.

The embodiment of the release device of this invention illustrated in FIGS. 6–9 affords an infinite number of adjustments of sensitivity over a range, as distinguished from the three settings afforded by the three notches illustrated in FIG. 4. This is achieved by replacing the pawl 20 on the forward end of the body member 10 of the previously described embodiment with a pawl bar 50, which operatively engages the body member 10' through an adjustable base bar 52. The pawl bar is secured intermediate its ends to an intermediate portion of the arm 22', by means of a pivot pin 54, the axis of which is parallel to the axes of the pivot pins 24' and 44'.

The rearward end portion of the adjustable bar 52 is provided with a slot 56 for reception of the lock screw 58 the threaded shank of which is received in a threaded bore in the body member 10'. The elongated slot affords longitudinal adjustment of the bar 52 relative to the arm 22' and bar 50. The forward end of the bar 52 provides an abutment by which to limit the degree of clockwise rotation of the arm 22' about the axis of its pivot 24'.

The outer surface of the base bar 52 provides a sliding base for the rearward end of the pawl bar 50. The distance B from the forward end of the base bar to the position of engagement of the rearward end of the pawl bar, when the support lever 42' is in cocked position, is inversely proportional to the sensitivity of release of the support lever. As will be apparent from FIG. 6, this distance is increased by moving the base bar forwardly and is decreased by moving the base bar rearwardly.

In the use of the release device illustrated in FIGS. 6–9, the pawl bar 50 is rotated fully counterclockwise about the axis of its pivot pin 54; the support lever 42' is rotated clockwise about the axis of its pivot pin 44' until the catch 46' abuts the forward end of the pawl bar 50, and then the arm 22' is rotated clockwise about the axis of its pivot pin 24' until it abuts the forward end portion of the base bar 52. In this position, illustrated in FIG. 6, the support lever is in cocked position, whereupon the bow string S may be seated in the hook 48' of the support lever in preparation for drawing an arrow.

With the arrow fully drawn and the bow properly sighted on the target, rotation of the body member 10' about the axis of pivot pin 24' through the angle C (FIG. 9), as explained hereinbefore in connection with the embodiment of FIG. 1–5, causes the rearward end of the pawl bar 50 to slide forward through the distance B (FIG. 6) to the forward end of the base bar 52. Because of the force of the tensioned bow string urging the lever 42' to rotate clockwise about its pivot 44', the pawl bar 50 is caused to be rotated clockwise about the axis of its pivot pin 54. The forward end of the bar 50 being thus disengaged from the catch 46', the lever 42' pivots quickly clockwise about the axis of its pivot pin 44' to the position shown in FIG. 9, releasing the bow string as previously described.

If desired, the release of this invention may be constructed to provide a fixed degree of sensitivity of release. Thus, the pivot 24 of the embodiment illustrated in FIGS. 1–5 may be confined in a single opening, such as opening 34, in the body member 10. Similarly, in the embodiment illustrated in FIGS. 6–9 the base bar 52 may be formed as an integral, fixed part of the body member 10'.

It is to be observed that the release of this invention may be utilized with equal effectiveness by both right and left handed archers.

It will be apparent to those skilled in the art that various changes may be made in the size, shape, type, number and arrangement of parts described hereinbefore without departing from the spirit of this invention.

Having thus described my invention and the manner in which it may be used, I claim:

1. A triggerless archery bow string release, comprising:

a. an elongated body member having forward and rearward ends, b. a finger grip connected to the rearward end of the body member and extending laterally from both sides of the body member, c. an arm mounted pivotally at its rearward end on the body member on a transverse pivot mounting, projecting forwardly beyond the forward end of the body member, and extending generally along the longitudinal axis of the body member, d. a bow string support lever mounted pivotally intermediate its ends of the forward end of the arm, e. a catch on one end of the lever, f. pawl means operatively associated with the body member for releasably engaging the catch for releasably securing the lever by rotating the body member in one direction about the pivotal axis of the arm to move the pawl means away from the catch to release the lever from cocked position and by rotating the body member in the opposite direction and rotating the lever so that the means will engage the catch, and g. bow string retainer means on the opposite end of the lever for supporting a bow string when the lever is in said cocked position and for releasing a bow string when the lever is pivoted to uncocked position upon disengagement of the pawl means from the catch.

2. The bow string release of claim 1 including adjustment means on the body member operatively associated with the pawl means for varying the degree of sensitivity of release of the lever from its cocked position.

3. The bow string release of claim 2 wherein the pawl means comprises a fixed projection on the body member and the catch comprises a notch in the lever, and the adjustment means comprises a plurality of laterally spaced bearing means on the body member for selective engagement by the pivot mounting of the rearward end of the arm.

4. The bow string release of claim 2 wherein the pawl means comprises a pawl bar mounted on the arm for pivotal movement of its forward end toward and away from the catch, and a base member on the body member slidably supporting the rearward end of the pawl bar in the cocked position of the lever, the base member having a forward end over which the pawl bar is slidable to release the lever from its cocked position, and the adjustment means comprises means mounting the base member on the body member for adjustment of its forward end longitudinally relative to the pawl bar.

5. The bow string release of claim 1 wherein the pawl means comprises a fixed projection on the body member and the catch comprises a notch in the lever.

6. The bow string release of claim 1 wherein the pawl means comprises a pawl bar mounted on the arm for pivotal movement of its forward end toward and away from the catch, and a base member on the body member slidably supporting the rearward end of the pawl bar in the cocked position of the lever, the base member having a forward end over which the pawl bar is slidable to release the lever from its cocked position.

7. The bow string release of claim 6 wherein the base member comprises an adjustable bar mounted on the body member for adjustment of its forward end longitudinally relative to the pawl bar.

8. The bow string release of claim 1 wherein the finger grip is elongated laterally relative to the body member and is secured intermediate its ends to the body member, arm and lever for rotational adjustment relative to the body member.

* * * * *

UNITED STATES PATENT AND TRADEMARK OFFICE

CERTIFICATE OF CORRECTION

PATENT NO. : 3,965,884

DATED : 29 June 1976

INVENTOR(S) : Gerald I. Killian

It is certified that error appears in the above-identified patent and that said Letters Patent are hereby corrected as shown below:

Column 6, lines 46 and 47 should read: -- body member for rotational adjustment relative to the body member, arm and lever. --

Signed and Sealed this

Seventh Day of September 1976

[SEAL]

*Attest:*

RUTH C. MASON
*Attesting Officer*

C. MARSHALL DANN
*Commissioner of Patents and Trademarks*